US008533966B2

(12) United States Patent
Mikhaylenko

(10) Patent No.: US 8,533,966 B2
(45) Date of Patent: Sep. 17, 2013

(54) CHALK LINE HOLDING DEVICE

(76) Inventor: Vadim V. Mikhaylenko, Jacksonville, FL (US)

( * ) Notice: Subject to any disclaimer, the term of this patent is extended or adjusted under 35 U.S.C. 154(b) by 227 days.

(21) Appl. No.: 13/092,726

(22) Filed: Apr. 22, 2011

(65) Prior Publication Data

US 2011/0258866 A1 Oct. 27, 2011

Related U.S. Application Data

(60) Provisional application No. 61/326,713, filed on Apr. 22, 2010.

(51) Int. Cl.
*B44D 3/38* (2006.01)

(52) U.S. Cl.
USPC ..... 33/414

(58) Field of Classification Search
USPC ..... 33/414, 1 LE, 409, 413, 1 G
See application file for complete search history.

(56) References Cited

U.S. PATENT DOCUMENTS

| | | | | | |
|---|---|---|---|---|---|
| 517,720 | A * | 4/1894 | Anderson | 33/414 |
| 2,853,785 | A * | 9/1958 | Raifsnider | 33/760 |
| 3,122,836 | A * | 3/1964 | Aciego | 33/413 |
| 3,662,471 | A * | 5/1972 | Lynde | 33/770 |
| 4,731,933 | A * | 3/1988 | Cope | 33/414 |
| 4,921,507 | A * | 5/1990 | Beyer | 33/413 |
| 5,009,015 | A * | 4/1991 | Redl | 33/409 |
| 5,022,158 | A * | 6/1991 | Beyer | 33/413 |
| 6,360,445 | B1 * | 3/2002 | Haas | 33/16 |
| 6,578,274 | B1 * | 6/2003 | Tango et al. | 33/1 G |
| 7,051,446 | B2 * | 5/2006 | Moss | 33/429 |
| 7,506,454 | B1 * | 3/2009 | Balliet | 33/414 |
| 7,690,125 | B2 * | 4/2010 | Lenz | 33/414 |

* cited by examiner

*Primary Examiner* — Christopher Fulton
(74) *Attorney, Agent, or Firm* — Mark Young, P.A.

(57) ABSTRACT

A chalk line holding device includes a hook retainer and cord holder coupled to a body with a bottom pad defining a bottom channel. A hook retainer, which projects forward from the body, includes a feature for securing a hook ring at the free end of a chalk line, while the line extending from the hook ring is secured by the cord holder. The cord holder includes a leading edge, a leading edge groove at the bottom of the leading edge defined between a pair of hoof-like feet, a cord space beneath the cord holder, a vertical groove beneath and approximately aligned with the neck of the hook retainer. The bushing couples the handle, cord holder and hook retainer to the body. The body has sufficient mass or inertia to hold a retained chalk line in place while the line is plucked.

19 Claims, 14 Drawing Sheets

CHALK LINE HOLDING DEVICE

RELATED APPLICATION

This application is a nonprovisional of and claims the benefit of priority of U.S. provisional application 61/326,713, filed Apr. 22, 2010, the entire contents of which are incorporated herein and made a part hereof by this reference.

FIELD OF THE INVENTION

This invention relates generally to chalk lines, and, more particularly, to a device for holding and aligning a free end of a chalk line.

BACKGROUND

As is well known to tradesmen, a chalk line is an indispensible tool for marking long, straight lines on relatively flat surfaces, with endpoints spaced much farther apart than is practical with a straightedge. The tool typically comprises a refillable metal or plastic case containing powdered chalk and a spool of string (e.g., typically about 18- to 50-feet of line). A hook ring on the outside of the case attaches to the free the end of the string. A rewind crank connected to the spool is located on the side of the tool for winding the line into the case when the mark is made. The case typically has one pointed end so that it can double as a plumb bob.

A user marks straight lines by snapping the taut string coated and/or impregnated with dyed chalk. In use, the tool may be shaken to distribute chalk evenly inside the case. Next, the chalked string is laid across the surface to be marked and pulled tight. If possible, this entails connecting the hook ring to a stationary object at one endpoint of the line and pulling the case away from that endpoint towards the opposite endpoint of the line. As the case is pulled away, chalked line is withdrawn from the case. When the second endpoint is reached, the line is pulled taut. The string is then plucked or snapped sharply to cause the string to strike the surface, leaving a straight line of chalk residue.

To function properly, the ends of the string must be pulled in opposite directions until the desired length and tension are achieved. Because the length of string frequently exceeds a person's arm span, and because the taut string must be plucked, one individual alone typically cannot use a chalk line, unless the free end can be secured to something. In some situations, a nail may be driven into a surface to secure the hook ring at the free end to an endpoint. However, in other situations nailing may be impractical, because, for example, the surfaces may be finished or comprised of a material (e.g., a non-wood material) that is not suitable for receiving a nail. By way of example and not limitation, a nail cannot easily be driven into masonry or tile.

What is needed is an easy to use, portable, reliable, cost effective tool for securing the free end of a chalk line flush with various surfaces, without damaging the chalk line or the surface to be marked, and while centering the line at the desired end point.

The invention is directed to overcoming one or more of the problems and solving one or more of the needs as set forth above.

SUMMARY OF THE INVENTION

To solve one or more of the problems set forth above, in an exemplary implementation of the invention, a chalk line holding device for holding an end of a chalk line is provided. The chalk line includes a cord with a hook ring at the end. The hook ring includes a hook portion and a ring portion. The chalk line holding device includes a body, which is a three-dimensional structure, a hook retainer coupled to the body and a cord holder coupled to the body. The hook retainer engages the hook ring of the chalk line. The cord holder includes a base portion coupled to the body and a leading edge with a leading edge groove configured to engage a portion of the cord. The body may be comprised of a dense material, such solid steel (e.g., 8 to 216 cubic inches of solid steel), or a hollow container fillable with a dense material such as concrete, aggregate or sand, or a planar surface on which a heavy object may be placed.

The cord holder may be an L-shaped member, including the base portion and a holding portion generally perpendicular to the base portion. The leading edge of the cord holder defines a free end of the holding portion. The leading edge groove is at the bottom of the leading edge. The leading edge may include a pair of spaced apart feet, with the leading edge groove being a groove space between the feet. The bottom of the cord holder may include a cord space. A vertical groove is provided in the holding portion in alignment with the hook retainer.

A handle (e.g., an L-shaped handle) may be coupled to the body. The handle may be fixed or adjustable (e.g., adjustable in height and/or angular position). A coupler (referred to herein as a bushing) may be attached to the body. Components, such as the cord holder, hook retainer and/or handle may be attachable to the coupler. This facilitates manufacture, especially if the body is a heavy piece of steel.

The hook retainer may project outward from the body and include a head and threaded shank. The diameter of the threaded shank is smaller than the minor diameter of the ring portion and the diameter of the head may be larger than at least a portion of the minor diameter of the ring portion. The ring portion may have an opening with a uniform or varying diameter. In the latter case a major diameter may allow the ring portion to slide over the head. Then the minor diameter may be retained by the head. A sleeve may cover a portion of the threaded shank.

Alternatively, the hook retainer may be a slot in the body. The slot may be configured to receive the hook portion of the hook ring.

Optionally one or more laser emitters may be coupled to the body. The laser emitters emit a visible laser beam. They may be used for alignment and squaring. The laser emitters may be fixedly attached or removably attached.

A channel extends along the bottom from the front to the rear of the body. The channel provides a passageway for the cord. The bottom may include a non-slip pad, with the channel being defined in the non-slip pad.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the configuration, shapes, relative sizes, ornamental aspects or proportions of the components and assemblies shown in the figures.

DETAILED DESCRIPTION

Figure 1:
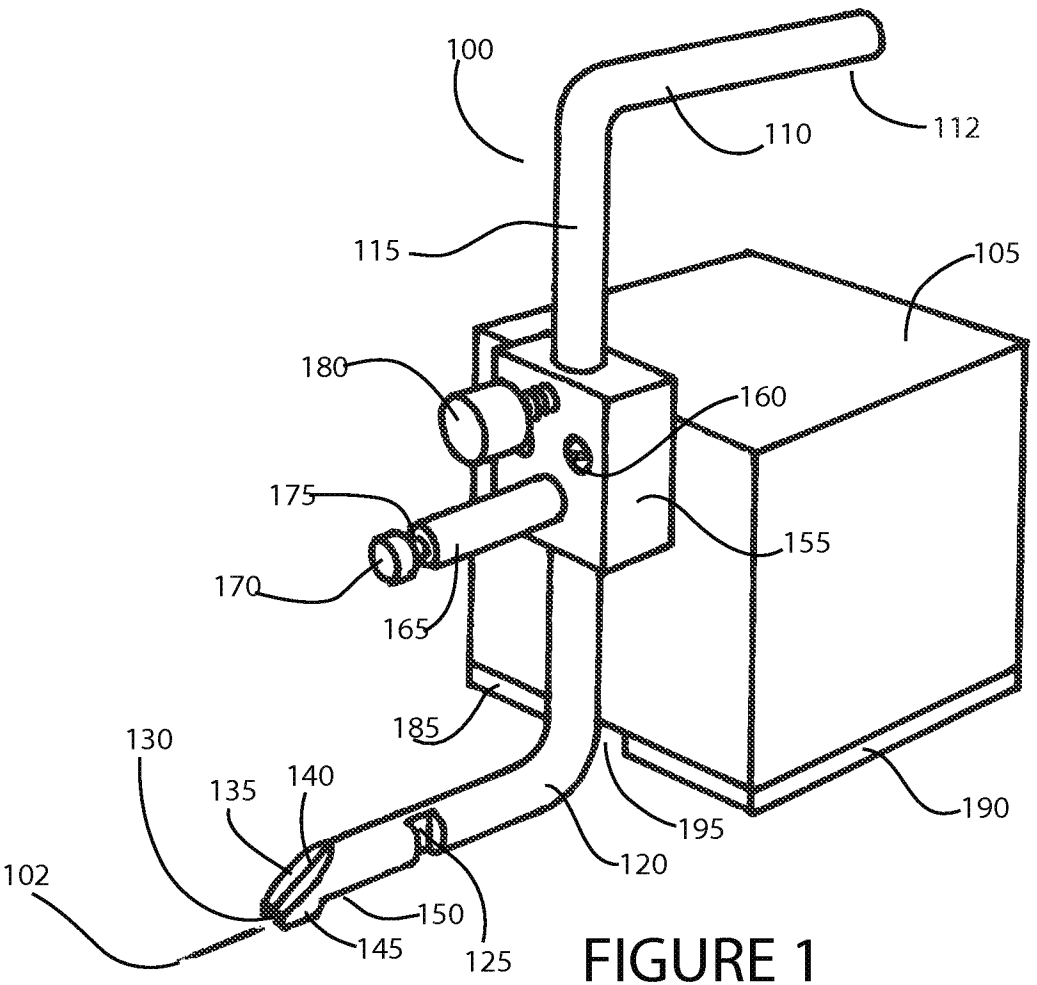
FIG. 1 is a top front perspective view of an exemplary chalk line holding device according to principles of the invention.

Referring to FIG. 1, a top front perspective view of an exemplary chalk line holding device 100 according to principles of the invention is shown. The device generally comprises a hook retainer 165 and cord holder 120 coupled to a body 105 with a bottom, such as bottom pad 190, defining a bottom channel 195 through which a line may be extended rearward.

The hook retainer 165 projects forward from the body 105. The hook retainer 165 includes a feature for securing a hook ring at the free end of a chalk line, while the line extending from the hook ring is secured by the cord holder 120. A bushing 155 couples the hook retainer 165 to the body 105. The hook retainer 165 includes a neck 175 and a head 170. The neck 175 has a smaller diameter than the opening in the hook ring. The head 170 has a larger diameter than the neck 175. In an exemplary embodiment, the head 170 and neck 175 comprise a screw. Thus, the screw may be removed to slip the neck through the opening in the hook ring and threaded into a threaded opening of the hook retainer, thereby securing the hook ring to the hook retainer 165. Alternatively, the head 170 of the screw may be sufficiently small to fit through the opening in the hook ring. Notably, the neck 175 of the hook retainer 165 is positioned above the slot 125 of the cord holder 120.

Figure 2:
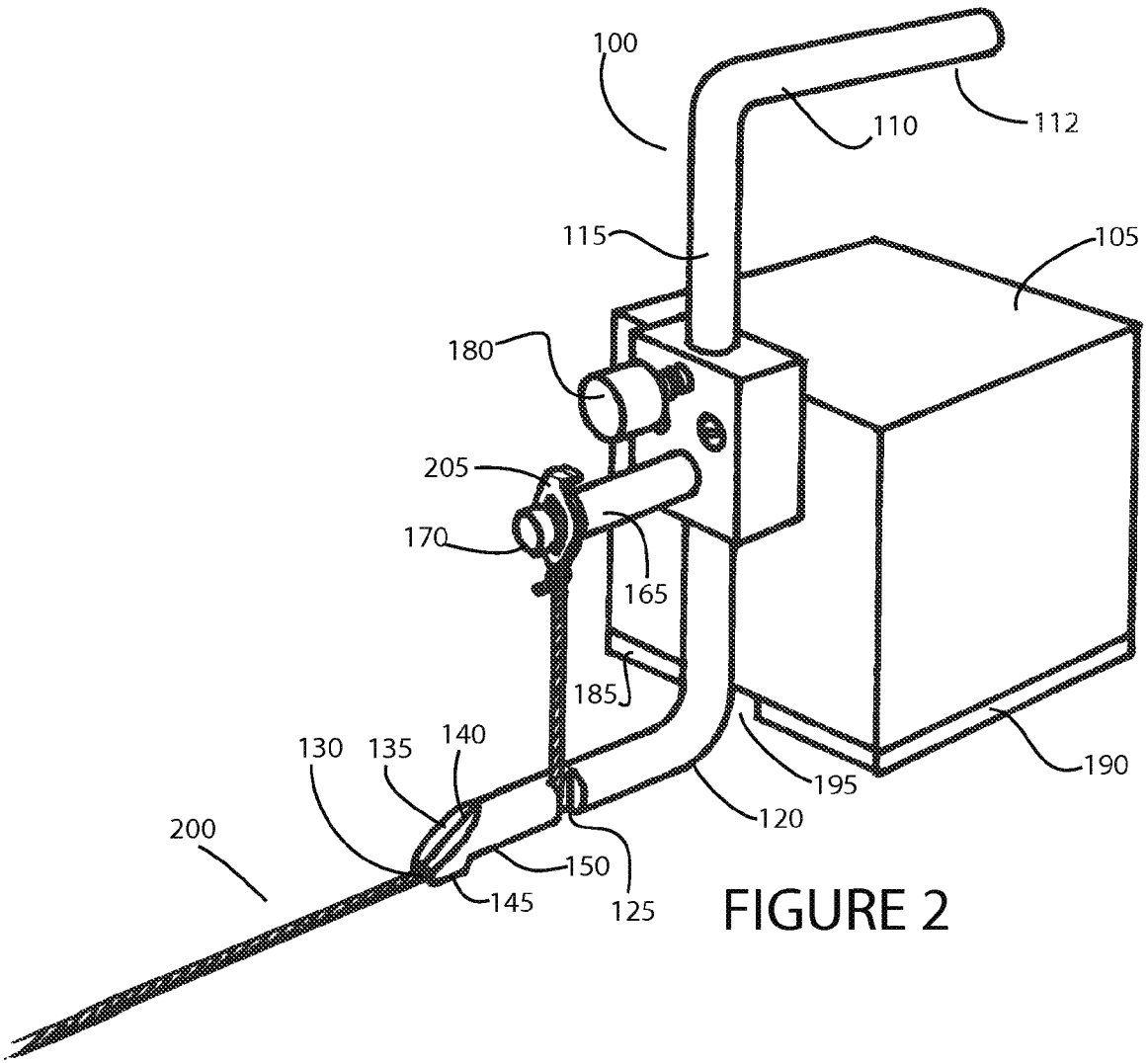
FIG. 2 is a top front perspective view of an exemplary chalk line holding device with a chalk line extending forward according to principles of the invention.
Figure 3:
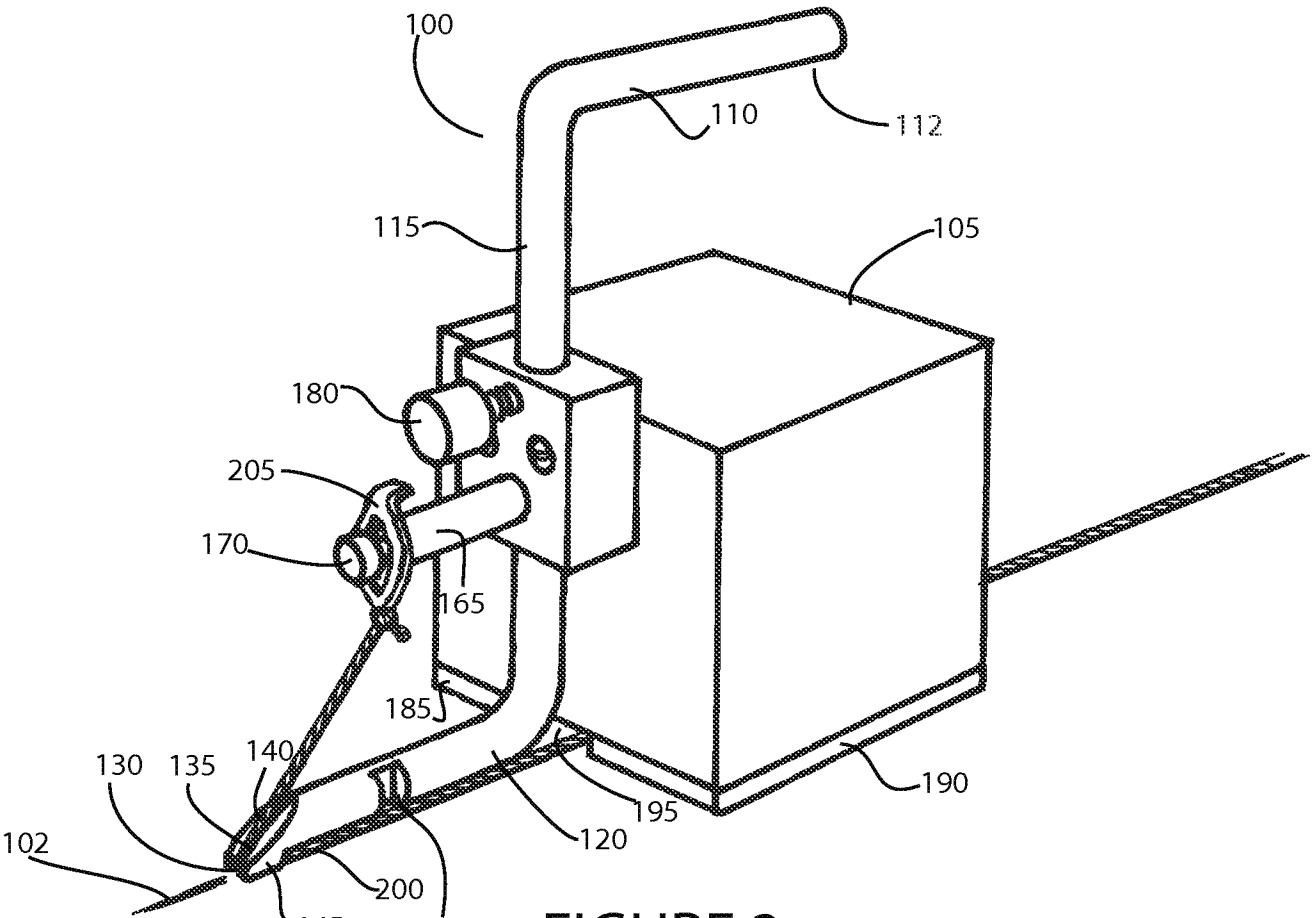
FIG. 3 is a top front perspective view of an exemplary chalk line holding device with a chalk line extending rearward according to principles of the invention.

The cord holder 120 comprises an L-shaped structure. One leg of the L includes a free end secured by the bushing 155. The other leg of the L includes a leading edge 135, a leading edge groove 130 at the bottom of the leading edge 135 defined between a pair of hoof-like feet 145, a cord space 150 beneath the cord holder 120, a vertical groove 125 beneath and approximately aligned with the neck 175 of the hook retainer 165. The leading edge 135 is an inclined plane 135 with a central longitudinal guide line 140. The inclined plane of the leading edge 135 enhances visibility of the guide line 140. The guide line 140 may be painted, printed, embossed, engraved or otherwise visibly formed on the leading edge 135. The guide line 140 facilitates alignment with a pencil mark 102 or other reference indicia. The cord space 150 allows passage of a line beneath the cord holder 120. The vertical groove 125 beneath and approximately aligned with the neck 175 of the hook retainer 165 allows the hook retainer 165 to engage a hook ring 205, while the line 200 extends downwardly through the vertical groove 125 and then either forward through the cord space 150 and through the groove 130, as illustrated in FIG. 2, or rearward through the bottom channel 195 beneath the body 105, as illustrated in FIG. 3. In each case, the vertical groove 125 is configured (i.e., has sufficient depth) to allow the line to extend along the midline of the cord holder 120. Cord holders having shapes other than an L, and cord holders secured to the bushing or body using other fastening means may be used without departing from the spirit and scope of the invention.

A handle 110 projects upwardly from the body 105. The handle 110 facilitates carrying, placement and orientation of the device 100. The exemplary handle 110 is generally L-shaped with one segment 115 extending into a channel of the bushing 155. A threaded shank of the knob 180 threads into the bushing 155 and secures the segment 115 of the handle 110 to the bushing 155. The other segment 112 of the handle 110 is generally perpendicular to the segment 115 engaged by the bushing 155. The handle 110 may swivel by loosening the knob 180. Swiveling allows a convenient orientation and avoidance of nearby obstacles. Handles having shapes other than an L, and handles secured to the bushing or body using other fastening means may be used without departing from the spirit and scope of the invention.

The bushing 155 couples various components to the body 105. In an exemplary embodiment, the bushing 155 couples the handle 110, cord holder 120 and hook retainer 165 to the body 105. In the exemplary embodiment, a pair of screws 160 secures the bushing 155 to the body. Secured ends of the handle 110, cord holder 120 and hook retainer 165 are received in female channels provided in the bushing 155. Screws, such as the handle knob 180 and hook retainer 165 secure the ends of handle 110 and cord holder 120 in their respective channels. Bushings having shapes other than cubic, and embodiments without a bushing or a bushing secured to the body using other fastening means may be used without departing from the spirit and scope of the invention.

The body 105 has sufficient mass or inertia to hold a retained chalk line in place while the line 200 is plucked. In a preferred embodiment, the body comprises solid metal (e.g., steel), such as a block of steel having dimensions of 2 to 6 inches in width, by 2 to 6 inches in height, by 2 to 6 inches in depth. However, bodies comprised of other materials and having other dimensions and shapes may be used within the spirit and scope of the invention. By way of example and not limitation, an alternative body may comprise a hollow body that includes a compartment that may be filled with a dense material (e.g., concrete, sand or aggregate), or a body equipped with suction cups to secure the body in place on smooth non-porous (e.g., the or glass) surfaces, or a planar body upon which a heavy object may be placed.

Referring now to FIG. 2, a top front perspective view of an exemplary chalk line holding device 100 with a chalk line 200 extending forward according to principles of the invention is conceptually illustrated. A hook ring 205 is retained behind the head 170 on the neck 175 of the hook retainer 165. A line 200 extends from the hook ring 205 down through the vertical groove 125. The line 200 then bends and extends forward in the cord space 150 and through the leading edge groove 130 at the bottom of the leading edge 135 defined between the pair of hoof-like feet 145. In this implementation, the rear of the body 105 may abut a surface such as a wall or floor. The handle 110 does not interfere with a wall or floor because the horizontal segment 110 does not extend past the rear of the body 105. Additionally, the handle 110 may be swiveled to avoid interference with a structure such as a floor or wall.

Referring now to FIG. 3, a top front perspective view of an exemplary chalk line holding device 100 with a chalk line 200 extending rearward according to principles of the invention is conceptually shown. A hook ring 205 is retained behind the head 170 on the neck 175 of the hook retainer 165. A line 200 extends forwardly from the retained hook ring 205 down through the leading edge groove 130. The line 200 then bends and extends rearward in the cord space 150 and through the channel 195 between the portions of the bottom pad 190. In this implementation, the free end of the leading edge may abut a surface such as a wall.

As shown in FIGS. 2 and 3, a chalk line holding device 100 according to principles of the invention is quite versatile. A line 200 may extend forward or rearward. The body 105 or leading edge 135 may be positioned flush against a structure.

Figure 4:
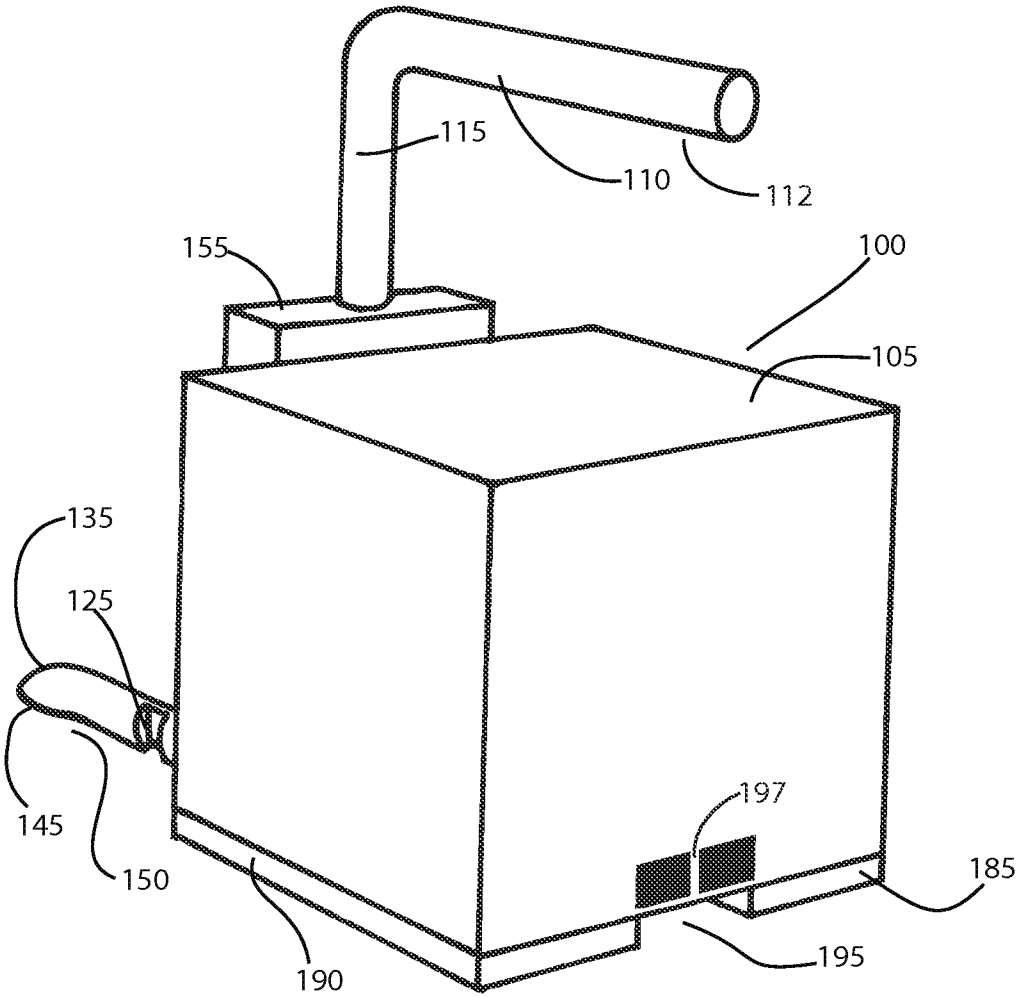
FIG. 4 is a top back perspective view of an exemplary chalk line holding device according to principles of the invention.

FIG. 4 is a top back perspective view of an exemplary chalk line holding device 100 according to principles of the invention. The channel 195 between the pad portions 185, 190 is clearly visible. Optionally, a gauge 197 may be provided above the channel 195 to clearly identify the center of the channel 195. The gauge 197 may comprise one or more indicia, such as a visible line denoting the center of the channel. The visible line of the gauge 197 may be painted, printed, embossed, engraved or otherwise visibly formed.

Figure 5:
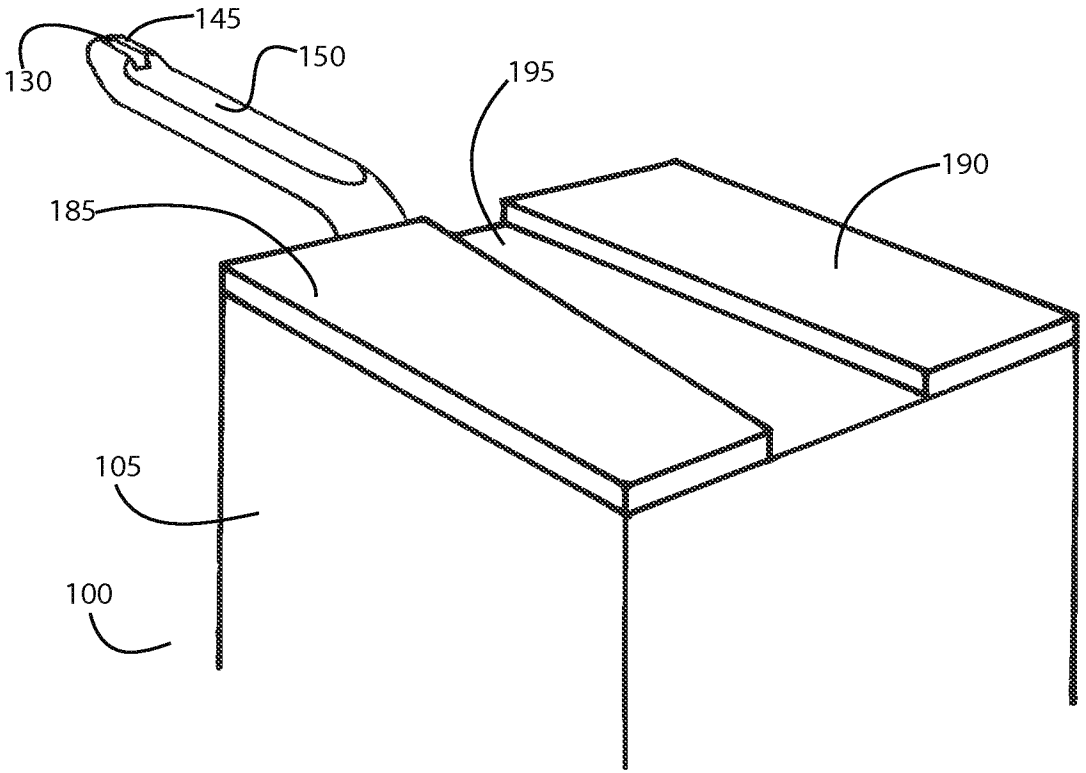
FIG. 5 is a bottom back perspective view of an exemplary chalk line holding device according to principles of the invention.

Referring to FIG. 5, a bottom back perspective view of an exemplary chalk line holding device 100 according to principles of the invention is conceptually shown. Again, the channel 195 between the pad portions 185, 190 is clearly visible. The exemplary channel tapers in width, with a narrower width at the front and a wider width at the back.

Figure 6:
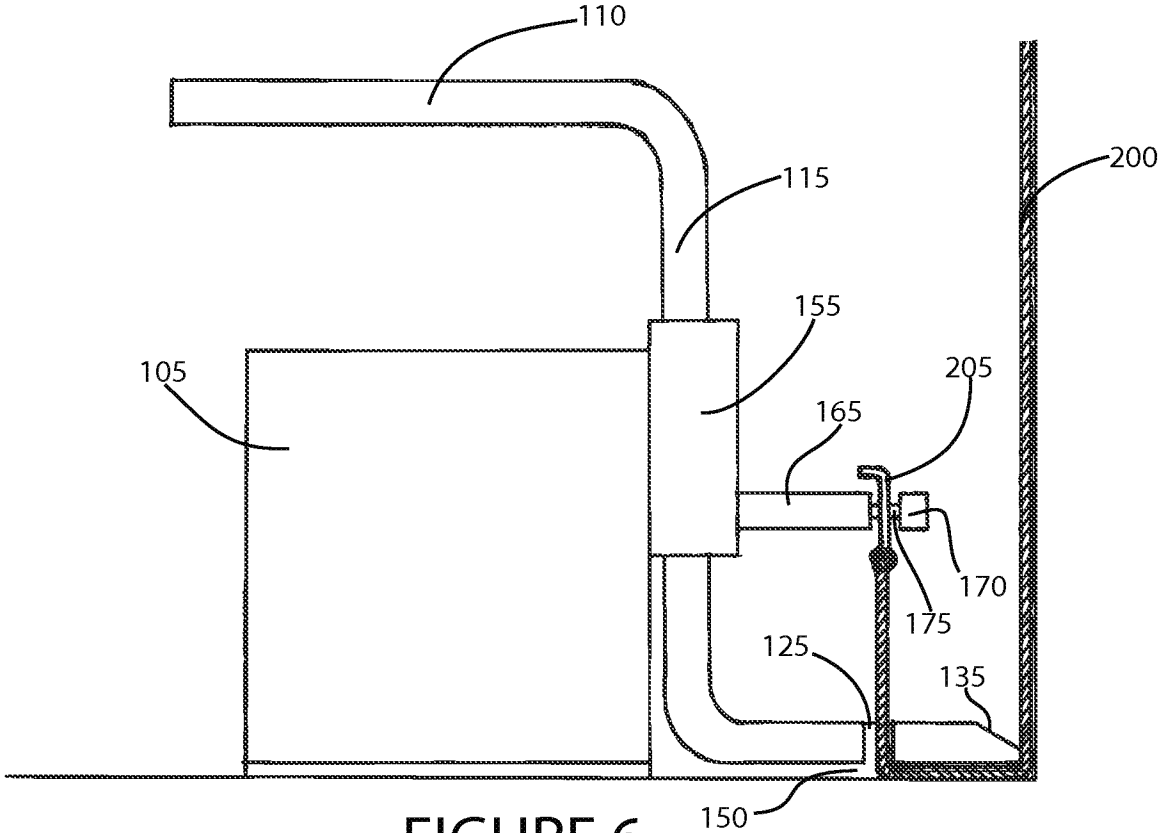
FIG. 6 is a side view of an exemplary chalk line holding device according to principles of the invention.

Referring now to FIG. 6, a side view of an exemplary chalk line holding device 100 according to principles of the invention is conceptually illustrated. The chalk line 200 extends forward and then upward. A hook ring 205 is retained behind the head 170 on the neck 175 of the hook retainer 165. The line 200 extends from the hook ring 205 down through the vertical groove 125. The line 200 then bends and extends forward in the cord space 150 and through the leading edge groove 130 at the bottom of the leading edge 135 defined between the pair of hoof-like feet 145. The line 200 then bends and extends upward. In this implementation, the leading edge 135 may urge the line 200 at the leading edge 135 against a corner formed by a wall and floor. This implementation enables forming a chalk line on a vertical surface such as a wall.

Figure 7:
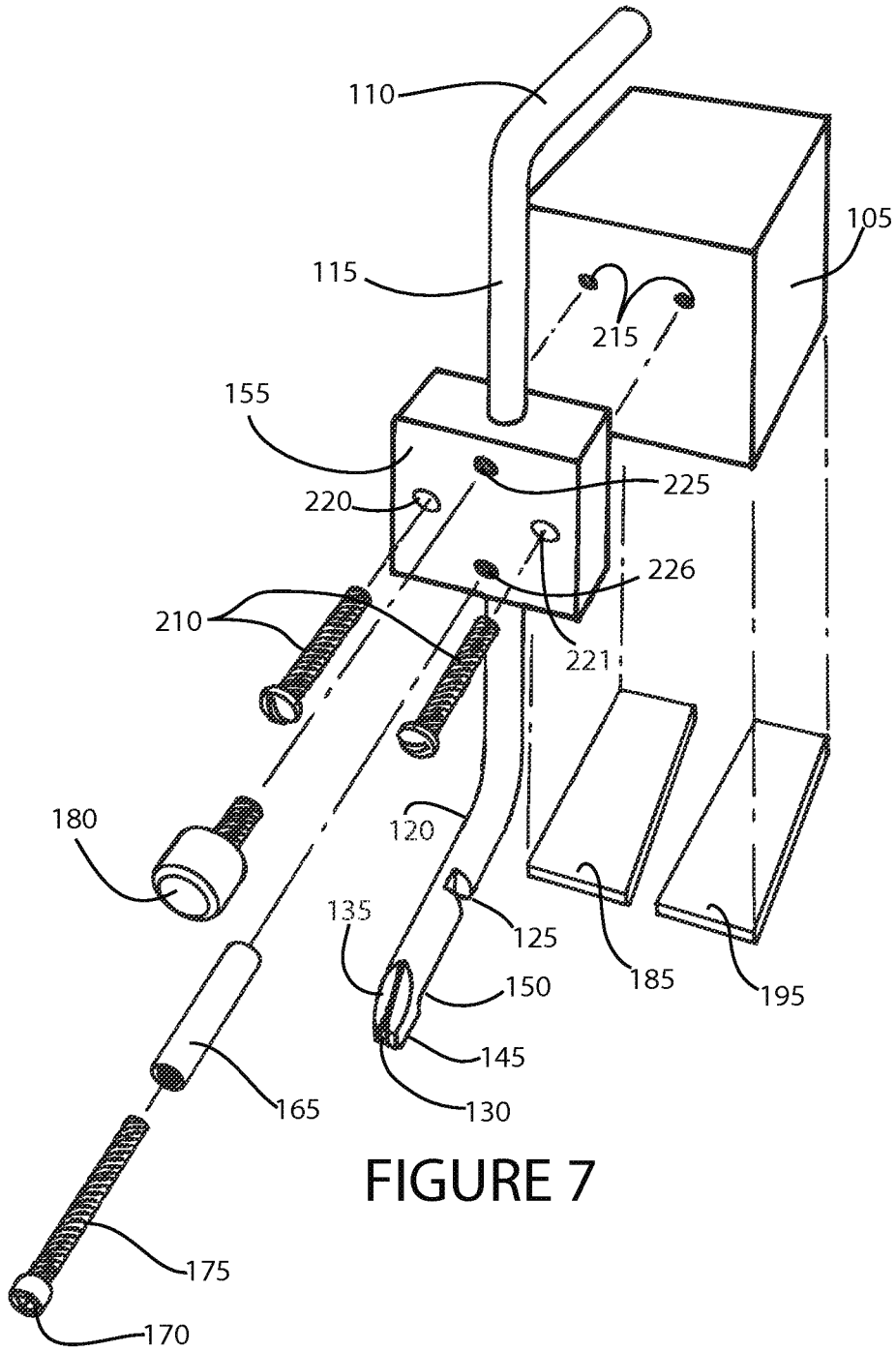
FIG. 7 is an exploded perspective view of an exemplary chalk line holding device according to principles of the invention.

FIG. 7 provides an exploded perspective view of an exemplary chalk line holding device 100 according to principles of the invention. The exemplary bushing 155 includes a pair of holes 220 (e.g., unthreaded holes) aligned with threaded holes 215 in the body 105. Screws 210 extend through the holes 220, 221 in the bushing 155 and thread into the holes 215 in the body 105 to secure the bushing 155 to the body 105. A knob 180 (i.e., thumbscrew) with a threaded shaft extends into a threaded hole 225 to secure the handle to the bushing. A screw having a head 170 and threaded shank 175 secures the hook retainer 165 to another threaded hole 225 in the bushing 155. The screw also fastens the cord holder 226 to the bushing.

Figure 8:
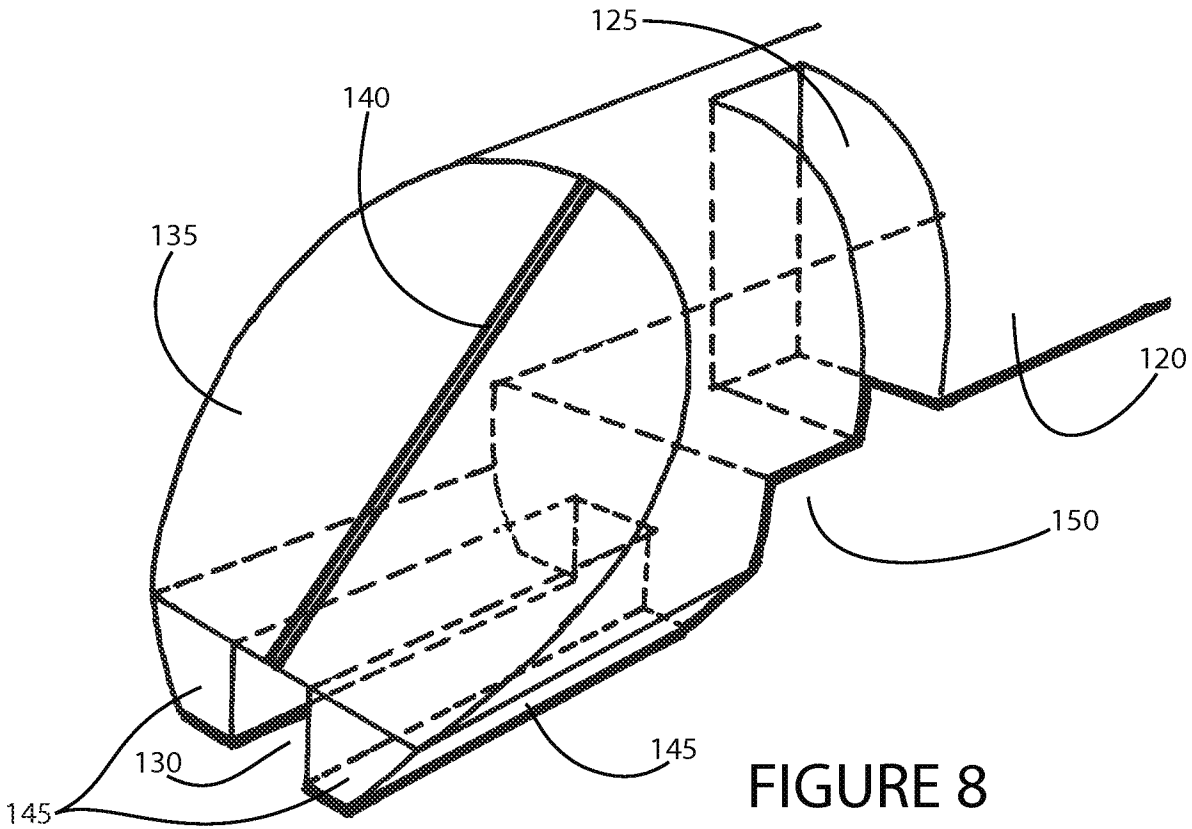
FIG. 8 is a perspective view of an exemplary cord holder of an exemplary chalk line holding device according to principles of the invention.

FIG. 8 is a magnified perspective view of the tip of an exemplary cord holder 120 of an exemplary chalk line holding device 100 according to principles of the invention. Hidden lines are dotted in FIG. 8. The tip includes a leading edge 135, a leading edge groove 130 at the bottom of the leading edge 135 defined between a pair of hoof-like feet 145, a cord space 150 beneath the cord holder 120, a vertical groove 125 beneath and approximately aligned with the neck 175 of the hook retainer 165. The leading edge 135 is an inclined plane 135 with a central longitudinal guide line 140. The inclined plane of the leading edge 135 enhances visibility of the guide line 140. The guide line 140 may be painted, printed, embossed, engraved or otherwise visibly formed on the leading edge 135. The guide line 140 facilitates alignment with a pencil mark 102 or other reference indicia. The leading edge groove 130 allows passage of the cord 200 below the leading edge 135. The cord space 150 allows passage of a line beneath the cord holder 120. The vertical groove 125 beneath and approximately aligned with the neck 175 of the hook retainer 165 allows the hook retainer 165 to engage a hook ring 205, while the line extends downwardly through the vertical groove 125 and then either forward through the cord space 150 and through the groove 130 or rearward through the bottom channel 195 beneath the body 105.

Figure 9:
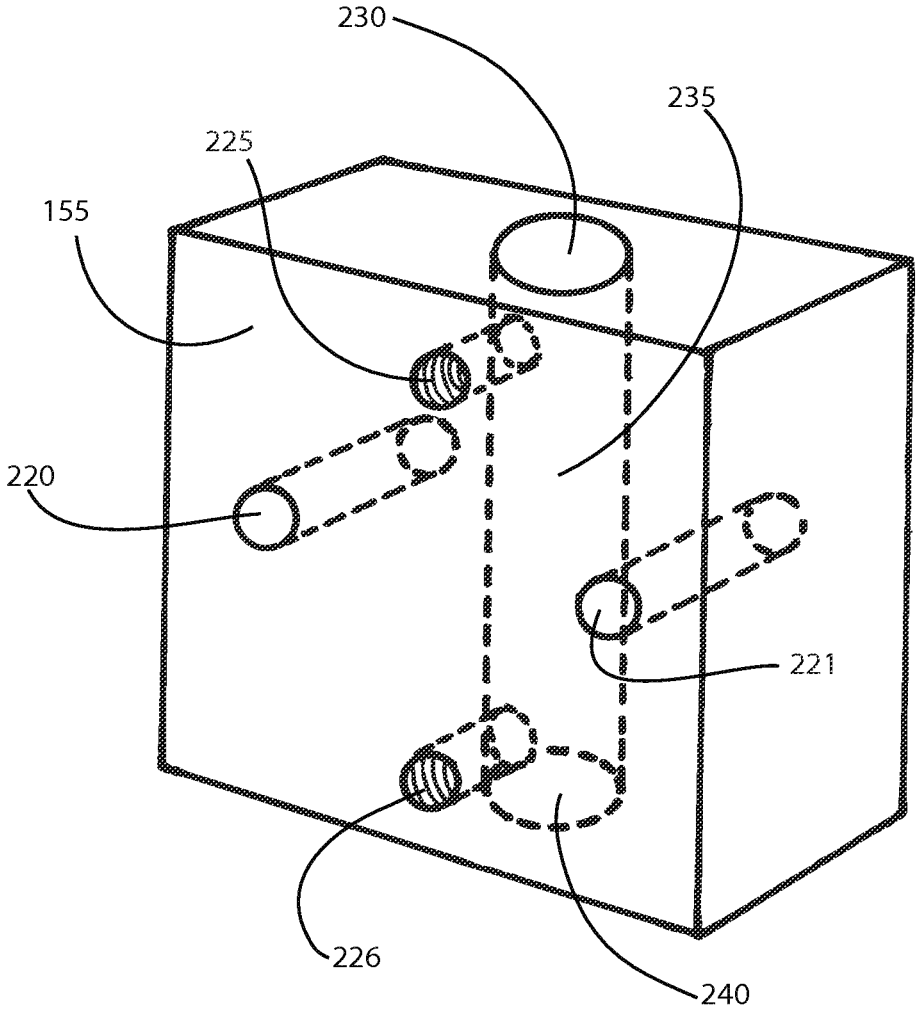
FIG. 9 is a top perspective view of an exemplary bushing of an exemplary chalk line holding device according to principles of the invention.

FIG. 9 is a top perspective view of an exemplary bushing 155 of an exemplary chalk line holding device 100 according to principles of the invention. The bushing 155 includes a pair of holes 220, 221 (e.g., unthreaded holes) aligned with threaded holes 215 in the body 105. Screws 210 extend through the holes 200 in the bushing 155 and thread into the holes 215 in the body 105 to secure the bushing 155 to the body 105. The upper threaded hole 225 is in communication with (i.e., extends to) the top channel 230. A knob 180 (i.e., thumbscrew with a threaded shaft) extends into the upper threaded hole 225 to secure the handle 110 to the bushing 155. An end of the vertical leg 115 of the handle 110 is received in the top channel 230. A screw having a head 170 and shank 175 secures the hook retainer 165 to the lower threaded hole 226 in the bushing 155. The lower threaded hole 226 is in communication with (i.e., extends to) the bottom channel 240. The screw also fastens the cord holder 120 to the bushing 155. An end of the cord holder 120 is received in the bottom channel 240.

Figure 10:
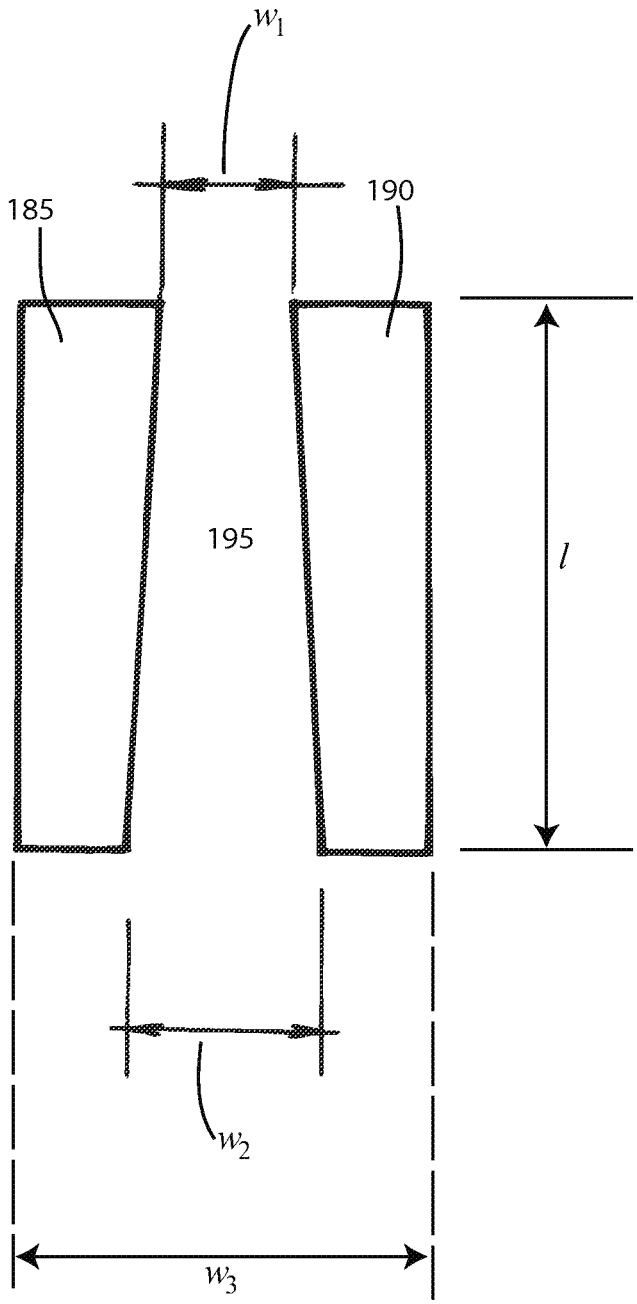
FIG. 10 is a plan view of an exemplary pair of pads for an exemplary chalk line holding device 100 according to principles of the invention.

FIG. 10 is a plan view of an exemplary bottom assembly comprising a pair of pads for an exemplary chalk line holding device 100 according to principles of the invention. The channel 195 between the pad portions 185, 190 is clearly visible. The exemplary channel tapers in width, with a narrower width, $w_1$, at the front and a wider width, $w_2$, at the back. The total width, $w_3$, is preferably equal to or about equal to the width of the body 105. The total length, l, is preferably equal to or about equal to the length of the body 105. The pad preferably is a rubber or other elastomer that exhibits a high coefficient of friction, to resist sliding motion, on surfaces of construction material on which a line will be formed (e.g., wood, tile, concrete, dry wall, plaster, steel, glass, aluminum, vinyl, etc.).

Figure 11:
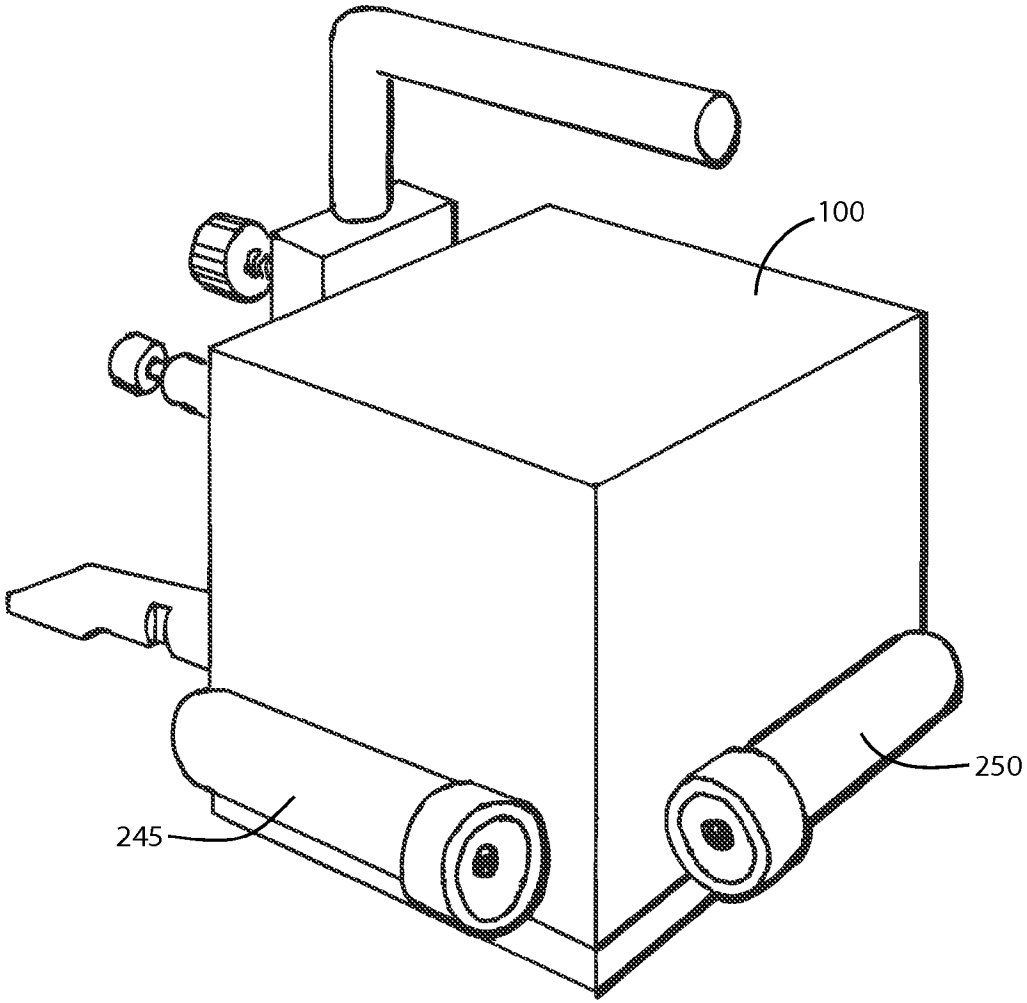
FIG. 11 is a top back perspective view of an exemplary chalk line holding device with lasers according to principles of the invention.

Referring now to FIG. 11, a top back perspective view of an exemplary chalk line holding device 100 with laser modules 245, 250 according to principles of the invention. The laser modules 245, 250 are oriented at a right angle relative to each other. Each laser module 245, 250 emits a straight beam of visible laser light, which may be used to determine alignment and orientation. Thus, for example, after a first chalk line has been formed, the laser modules may be used to generate a perpendicular laser line and mark the surface so that a perpendicular chalk line may be formed.

Figure 12:
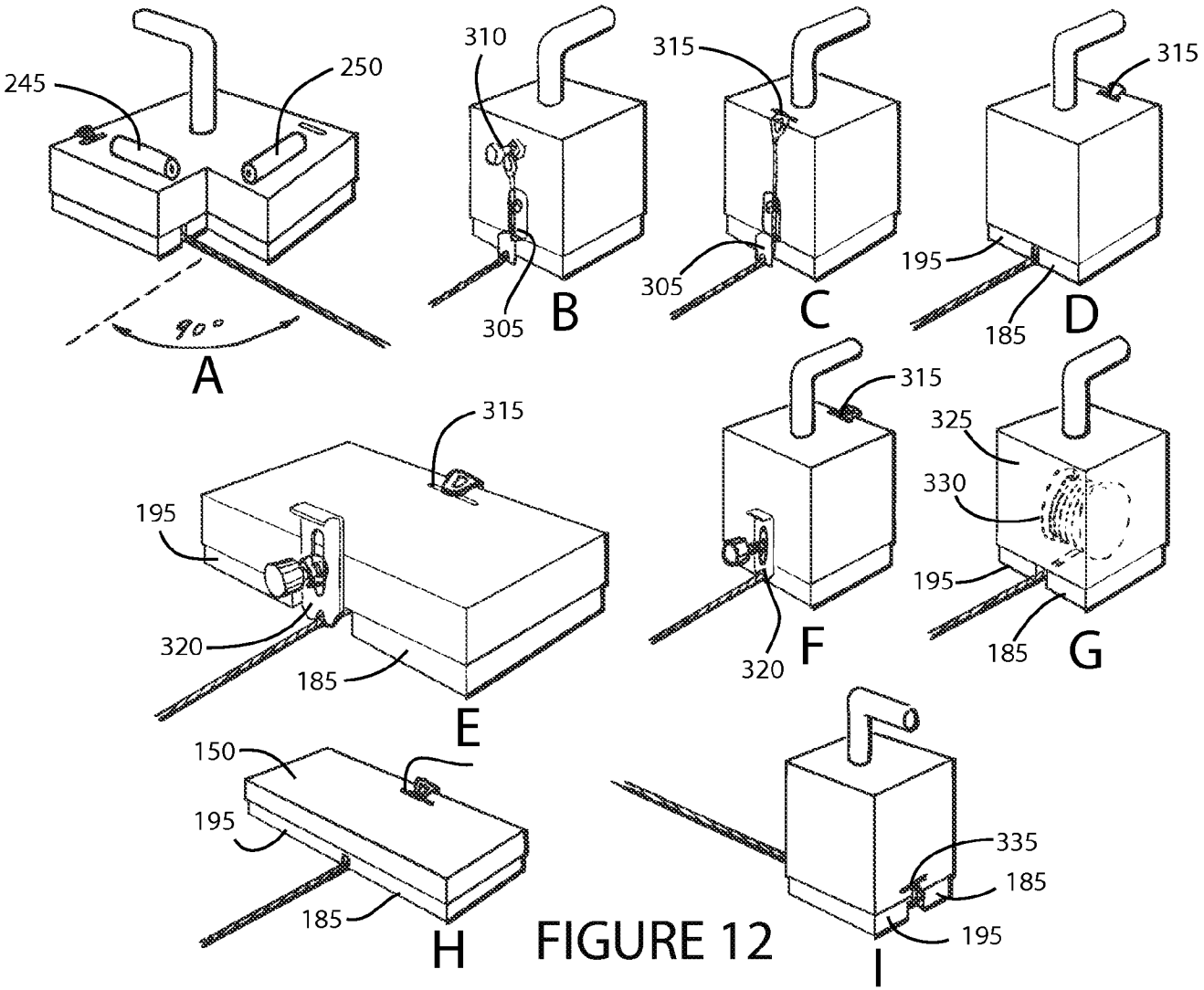
FIG. 12 provides perspective views of various alternative embodiments of an exemplary chalk line holding device according to principles of the invention.

FIG. 12 provides perspective views of various alternative embodiments of an exemplary chalk line holding device 100 according to principles of the invention. Embodiment A shows a unit equipped with a pair of laser modules 245, 250. The laser modules 245, 250 may be used as discussed above. Embodiment B depicts a unit with a retainer 310 and cord holder 305 that are substantially flush to the body. Embodiment C depicts a unit with a retainer slot 315 in the body 105 for receiving the hook of a hook ring 205 and a cord holder 305 that is substantially flush to the body. Embodiment D depicts a unit with a retainer slot in the body 105 for receiving the hook of a hook ring 205 and a cord extending rearward through a channel in the pads 185, 195 at the bottom of the body 105. Embodiment E depicts a unit with a wide body 150 and a retainer slot 315 in the top rear of the body 105 for receiving the hook of a hook ring 205 and a vertically and angularly adjustable cord holder 320 that is substantially flush to the body. Embodiment F depicts a unit with a retainer slot 315 in the top rear of the body 105 for receiving the hook of a hook ring 205 and an adjustable cord holder 320 that is substantially flush to the body 105. Embodiment G includes a body that contains powdered chalk 325 and a spool of string 330 with a rewind crank connected to the spool to rewind the line into the body when the mark is made. Embodiment H depicts a unit with a wide body 150 and a retainer slot 315 in the top rear of the body 105 for receiving the hook of a hook ring 205 and a channel between bottom pads 185, 195 extending through the bottom of body as a cord guide. Embodiment I depicts a unit with a retainer slot 335 in the bottom rear of the body 105 for receiving the hook of a hook ring 205 and a channel between bottom pads 185, 195 extending through the bottom of body as a cord guide.

Figure 13:
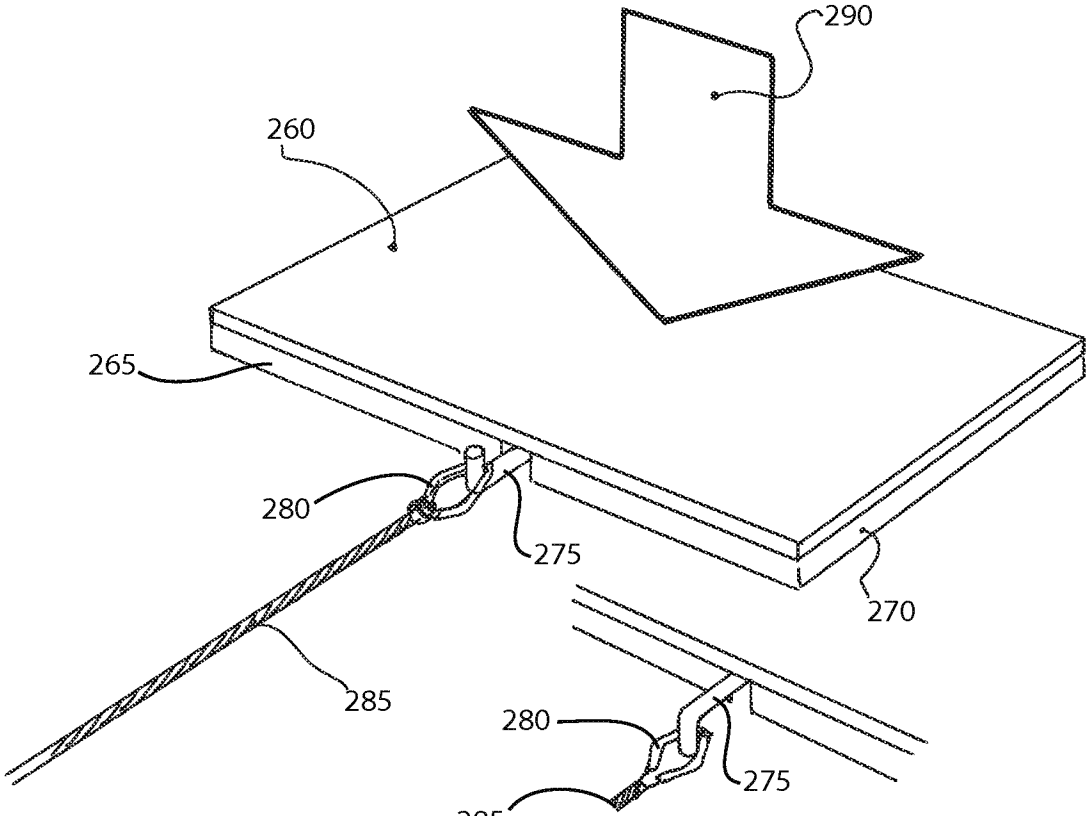
FIG. 13 is a top perspective view with alternative hook views for an exemplary alternative chalk line holding device according to principles of the invention.

FIG. 13 is a top perspective exploded view of an exemplary alternative chalk line holding device 100 according to principles of the invention. The body 260 comprises a planar surface upon which a mass is placed to resist movement. The weight of the mass is symbolized by the downward arrow 290. Pads 265, 270 are provided on the bottom of the body 260. A hook 275 to which a hook ring 280 may be attached projects from the channel between the pads 265, 270. The hook 275 may be oriented upward or downward.

Figure 14:
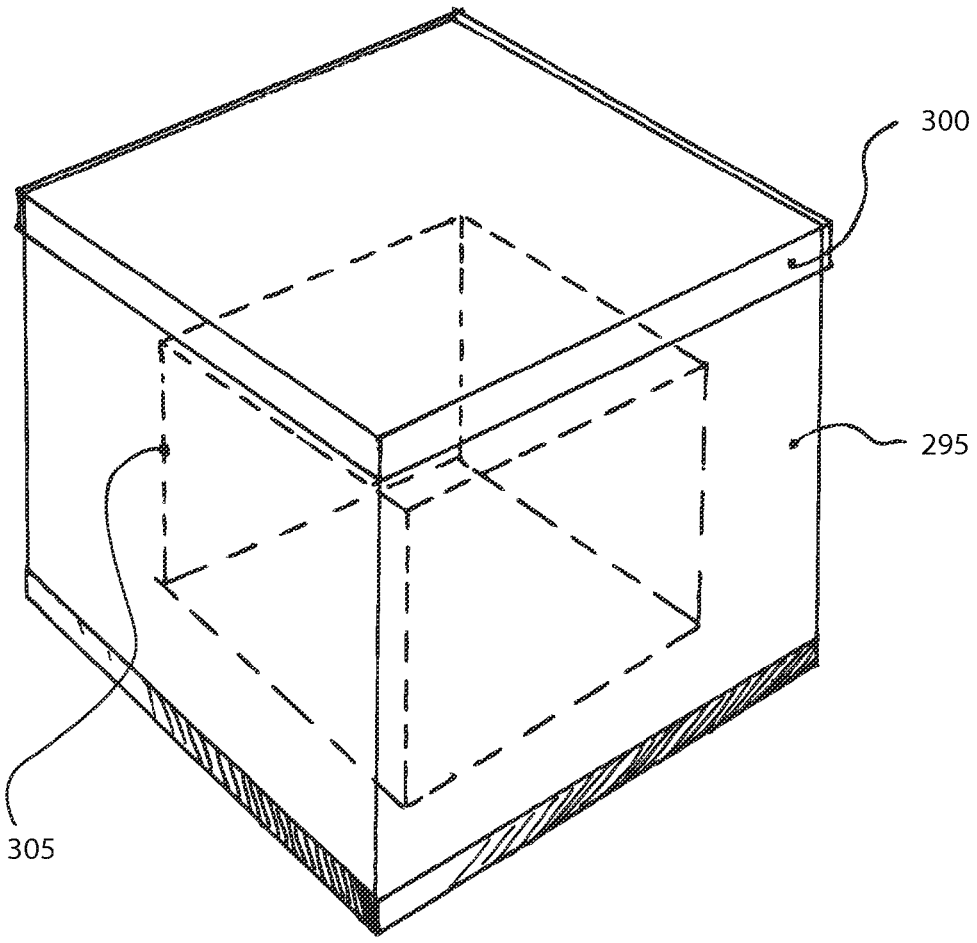
FIG. 14 is a top perspective view of a portion of an exemplary alternative chalk line holding device according to principles of the invention.

FIG. 14 is a top perspective view of another exemplary alternative chalk line holding device 100 according to principles of the invention. In this embodiment, the body 295 is hollow, with an interior compartment 305 accessible through a cover 300. The compartment 305 may be filled with a mass to provide weight to the body. This embodiment facilitates shipping and handling.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A chalk line holding device for holding an end of a chalk line comprising a cord with a hook ring at the end, said hook ring including a hook portion and a ring portion, said chalk line holding device comprising:

a body, said body comprising a three-dimensional structure; and a hook retainer coupled to the body, said hook retainer configured for engaging the hook ring of the chalk line; and a cord holder coupled to the body, said cord holder including a base portion coupled to the body and a leading edge with a leading edge groove configured to engage a portion of the cord; and said cord holder comprising an L-shaped member, including the base portion and a holding portion generally perpendicular to the base portion, the leading edge defining a free end of the holding portion, the leading edge groove being at the bottom of the leading edge, the base portion further including a vertical groove generally aligned with said hook retainer.

2. A chalk line holding device according to claim 1, said body comprising solid steel.

3. A chalk line holding device according to claim 1, said body comprising 8 to 216 cubic inches of solid steel.

4. A chalk line holding device according to claim 1, the leading edge of the cord holder comprising a pair of spaced apart feet, the leading edge groove being a groove space between the feet.

5. A chalk line holding device according to claim 4, the holding portion of the cord holder having a bottom including a cord space.

6. A chalk line holding device according to claim 1 further comprising a handle coupled to the body.

7. A chalk line holding device according to claim 1 further comprising an adjustable handle coupled to the body, said handle being adjustable in angular position relative to the body.

8. A chalk line holding device according to claim 1 further comprising a coupler attached to the body, said cord holder being coupled to the body by the coupler.

9. A chalk line holding device according to claim 1 further comprising a coupler attached to the body, said hook retainer being coupled to the body by the coupler.

10. A chalk line holding device according to claim 1, further comprising a slot in the body, said slot being configured for receiving the hook portion of the hook ring.

11. A chalk line holding device according to claim 1, said body comprising a hollow container and a solid filler material contained within the hollow container.

12. A chalk line holding device according to claim 1, said body comprising a planar surface onto which a weighted object may be supported.

13. A chalk line holding device according to claim 1, further comprising a laser emitter coupled to the body, said laser emitter configured to emit a visible laser beam.

14. A chalk line holding device according to claim 1, said body having a top, bottom, front and rear, and a channel extending along the bottom from the front to the rear, said channel providing a passageway for the cord.

15. A chalk line holding device according to claim 14, said bottom comprising a non-slip pad, said channel being defined in said non-slip pad.

16. A chalk line holding device for holding an end of a chalk line comprising a cord with a hook ring at the end, said hook ring including a hook portion and a ring portion, said chalk line holding device comprising:

a body, said body comprising a three-dimensional structure; and a hook retainer coupled to the body, said hook retainer configured for engaging the hook ring of the chalk line; and a cord holder coupled to the body, said cord holder including a base portion coupled to the body and a leading edge with a leading edge groove configured to engage a portion of the cord, and a coupler attached to the body, said hook retainer being coupled to the body by the coupler, said cord holder being coupled to the body by the coupler.

17. A chalk line holding device according to claim 16 further comprising an adjustable handle, said handle being coupled to the body by the coupler.

18. A chalk line holding device according to claim 17, said hook retainer projecting outward from the body and comprising a head and threaded shank, and said ring portion having an minor diameter, and said threaded shank having a shank diameter that is smaller than the minor diameter and said head having a head diameter that is larger than the minor diameter.

19. A chalk line holding device according to claim 18, said hook retainer further comprising a sleeve covering a portion of the threaded shank.

* * * * *